US005105588A

United States Patent [19]

Verley et al.

[11] Patent Number: 5,105,588

[45] Date of Patent: Apr. 21, 1992

[54] METHOD AND APPARATUS FOR SIMULTANEOUSLY FORMING A PLURALITY OF OPENINGS THROUGH A SUBSTRATE

[75] Inventors: Wayne E. Verley, Monmouth; Timothy S. Hostetler, Corvallis; Charles R. Blakely, Corvallis; Charles C. Haluzak, Corvallis, all of Oreg.

[73] Assignee: Hewlett-Packard Company, Palo Alto, Calif.

[21] Appl. No.: 580,397

[22] Filed: Sep. 10, 1990

[51] Int. Cl.[5] ..... B24C 5/04

[52] U.S. Cl. ..... 51/439; 51/413; 51/319

[58] Field of Search ..... 51/439, 427, 413, 410, 51/319, 320; 239/536, 552, 555, 568

[56] References Cited

U.S. PATENT DOCUMENTS

| | | | |
|---|---|---|---|
| 2,524,097 | 10/1950 | Barr et al. | 51/439 |
| 2,907,200 | 2/1956 | Roberts et al. . | |
| 3,053,016 | 9/1962 | Johnston et al. . | |
| 3,084,484 | 4/1963 | Hall et al. . | |
| 3,257,759 | 7/1963 | Millhiser et al. . | |
| 3,514,851 | 6/1970 | Perkins et al. . | |
| 3,638,839 | 2/1972 | Weightman . | |
| 4,188,247 | 2/1980 | Ridgway et al. . | |
| 4,232,059 | 11/1980 | Profitt . | |
| 4,233,785 | 11/1980 | Abell | 51/439 |
| 4,272,612 | 6/1981 | Oliver | 51/439 |
| 4,528,782 | 7/1985 | Bean | 51/439 |

FOREIGN PATENT DOCUMENTS

| | | | |
|---|---|---|---|
| 59-030669 | 8/1982 | Japan . | |
| 0144962 | 6/1988 | Japan | 51/439 |
| 0527389 | 10/1940 | United Kingdom | 51/439 |
| 1187976 | 4/1970 | United Kingdom . | |
| 1254944 | 11/1971 | United Kingdom | 239/568 |
| 2164879A | 4/1986 | United Kingdom . | |

OTHER PUBLICATIONS

Article by Ingulli, C. N., entitled "Abrasive Jet Machining," published in *The Tool and Manufacturing Engineer*, pp. 28 and 30–33 (Nov. 1967).

Instruction manual from Comco, Inc. (May 1984) involving MB102 Microblaster.

Literature on "Airbrasive" nozzles by S. S. White Industrial Products.

*Primary Examiner*—Robert A. Rose

[57] ABSTRACT

An improved method and apparatus for abrasive jet machining. A special spray nozzle unit is provided which is mounted within a cavity in a retaining block. Each nozzle unit is preferably made of multiple components secured together within the cavity. Also, such unit includes at least two passageways therethrough. In a preferred embodiment, the unit is divided into two heads, each head being substantially triangular with a flattened apex. The retaining block has at least one port therethrough which communicates with the passageways in the heads. A flow of particulate materials into the block passes through the passageways in the heads, simultaneously producing multiple particulate streams. The multiple streams may then be directed toward a substrate in order to simultaneously produce a plurality of openings through the substrate.

16 Claims, 3 Drawing Sheets

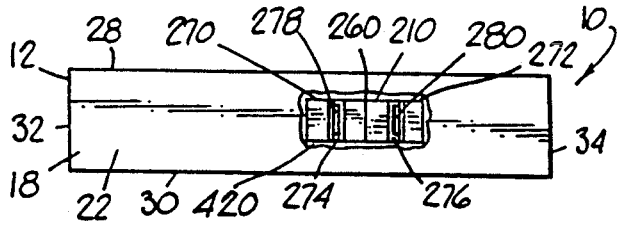
FIG. 5
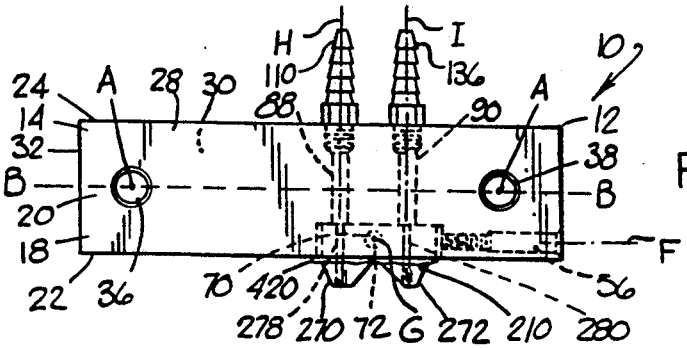
FIG. 6
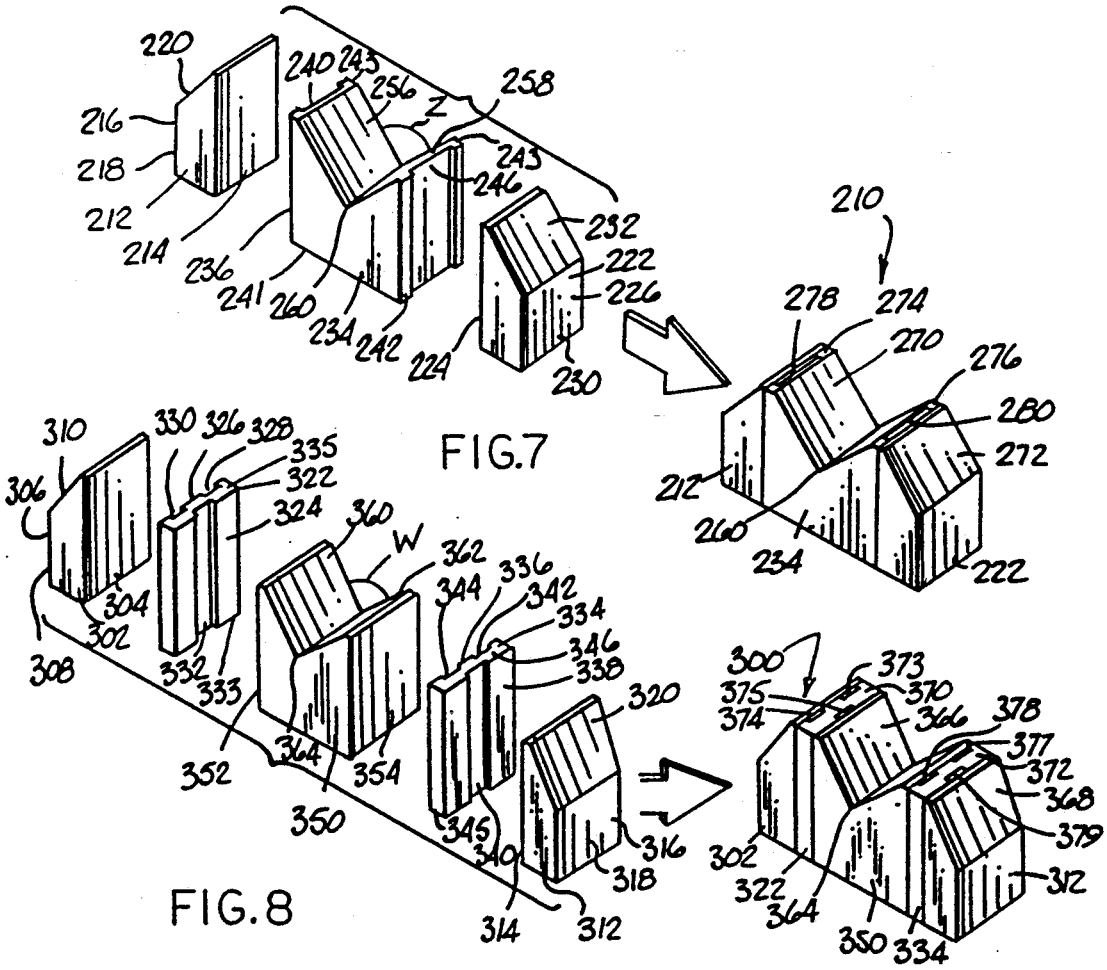
FIG. 7
FIG. 8

METHOD AND APPARATUS FOR SIMULTANEOUSLY FORMING A PLURALITY OF OPENINGS THROUGH A SUBSTRATE

BACKGROUND OF THE INVENTION

The present invention generally relates to the simultaneous formation of multiple openings through a substrate, and more particularly to a method and apparatus for simultaneously directing multiple streams of abrasive particles onto a substrate in order to form a plurality of openings therethrough.

The continuing development of sophisticated, miniaturized electronic systems has created a corresponding need for rapid and accurate manufacturing methods. Many electronic devices include components which must be produced with multiple openings/ports therethrough. For example, thermal ink jet cartridges typically include a substrate manufactured of silicon, glass, or the like to which an orifice plate and a plurality of jetting resistors are attached. The substrate normally includes one or more feed openings which enable ink to pass from a storage reservoir behind the substrate to the orifice plate and resistors. These openings are very small, and must be made to precise specifications.

Many methods have been used to produce the openings described above. For example, feed openings in the substrates of thermal ink jet cartridges have been made using conventional laser and/or ultrasonic drill systems However, these methods have not proven to be efficient or economical. Another method involves the formation of one opening at a time using a process known as "abrasive jet machining." This process involves the use of a nozzle which directs a stream of gas-accelerated abrasive particles (10–50 microns in diameter) at a selected substrate. The method can make openings as narrow as 0.005 inch or abrade an area of several square inches as discussed in an article by Ingulli, C. N. entitled "Abrasive Jet Machining," published in *The Tool and Manufacturing Engineer*, pp. 28–33 (Nov. 1987).

Using this process, each opening is made one at a time by a single nozzle. To cause the abrasive particles to be ejected from the nozzle, an apparatus is used which is attached to a source of pressurized gas (e.g. compressed air). The apparatus also includes a mixing chamber containing a supply of abrasive particles (e.g. aluminum oxide, silicon carbide, dolomite, and/or sodium bicarbonate). Activation of the apparatus causes a vibrator in the mixing chamber to operate. At essentially the same time, a valve within the system is opened, causing gas to flow through the apparatus and out of the nozzle. Vibration of the chamber causes some of the abrasive particles to escape from the mixing chamber through small openings therein so that the particles come in contact with the gas stream moving through the apparatus. As a result, the gas stream carries the particles through the nozzle at a high velocity (e.g. a flow rate of about 2–20 grams/minute). The particles then contact the substrate, causing the formation of an opening therethrough.

Most systems used to perform abrasive jet machining include controls for regulating gas pressure and the flow of particulate materials. Both of these factors independently influence the cutting action of the system. Conventional systems use an individual nozzle, each nozzle including a single orifice therein. The nozzle may be straight or bent to form a 90 degree angle. Exemplary materials used to produce the nozzles include tungsten carbide and sapphire. According to Ingulli, supra, tungsten carbide nozzles typically last between about 13–30 hours, while sapphire nozzles last for about 300 hours.

Other factors which influence cutting efficiency are the distance from the nozzle tip to the substrate, and the angle between the substrate and nozzle.

In general, abrasive jet machining offers numerous benefits in the production of electronic components. It is capable of forming an opening in a substrate with a high degree of accuracy, while avoiding damage to surrounding components and materials. Also, it is capable of cutting openings in many different types of substrates without the generation of excessive heat. Furthermore, it allows for improved relative placement accuracies during the production process. Additional general information regarding abrasive jet machining is disclosed in U.S. Pat. Nos. 2,907,200; 3,257,759; 3,514,851; 4,188,247; 4,232,059; and 4,272,612. Information is also provided in U.K. Patent 1,187,976; U.K. Patent Application 2,164,879A, and Japanese Patent Specification 59-030669.

The present invention involves an improved nozzle apparatus for abrasive jet machining. Specifically, the improved nozzle apparatus enables the simultaneous cutting of multiple openings in a substrate which represents an advance in the art, compared with conventional, single-bore systems. Other benefits of the invention include improved nozzle orifice size and configuration.

SUMMARY OF THE INVENTION

It is an object of the present invention to provide a system for abrasive jet machining of improved efficiency and accuracy.

It is a further object of the invention to provide a nozzle of improved design for an abrasive jet machining system which is capable of forming openings through a selected substrate in a rapid and accurate manner.

It is a still further object of the invention to provide a nozzle of improved design for an abrasive jet machining system which is capable of efficiently forming openings in a wide variety of different substrates.

It is a still further object of the invention to provide a nozzle of improved design for an abrasive jet machining system which is highly durable and abrasion resistant.

It is a still further object of the invention to provide a nozzle of improved design for an abrasive jet machining system which enables the simultaneous delivery of multiple streams of abrasive materials onto a substrate in order to form a plurality of openings therethrough.

It is an even further object of the invention to provide a nozzle of improved design for an abrasive jet machining system which is readily custom manufactured to a variety of different specifications so that openings of a desired size may be formed through a substrate.

In accordance with the foregoing objects, an improved system for abrasive jet machining is provided. Specifically, a unique spray nozzle unit is provided which is mounted within a cavity in a retaining block. The nozzle unit is manufactured of abrasion-resistant material, and includes at least two passageways therethrough spaced apart from each other at a selected distance. In a preferred embodiment, the nozzle unit is divided into two separate spray heads, each head being substantially triangular in configuration with a flattened apex and having at least one of the above passageways extending therethrough. The retaining block has at least one port passing through the block which communicates with the passageways in the spray heads. As a result, a flow of particulate materials into the retaining block will be directed through the passageways in the heads toward a substrate. Since multiple passageways are used in the nozzle unit, a plurality of particulate streams are produced. This enables the simultaneous production of multiple openings through the substrate. Each nozzle unit is preferably made of a plurality of components secured together within the cavity in the retaining block. To retain the nozzle unit in position within the cavity, a portion of an adhesive material is positioned around the unit, covering any gaps between the cavity and the nozzle unit. In this manner, an air-tight seal between the cavity and the nozzle unit is maintained.

These and other objects, features, and advantages of the invention shall be described below in the following Brief Description of the Drawings and Detailed Description of Preferred Embodiments.

BRIEF DESCRIPTION OF THE DRAWINGS

Illustrative and presently preferred embodiments of the invention are shown in the accompanying drawings in which:

FIG. 5 is a bottom view of the retaining block of FIG. 1 having a spray nozzle unit mounted therein.

FIG. 6 is a side view of the retaining block of FIG. 1 having a spray nozzle unit mounted therein.

FIG. 7 is an enlarged, exploded perspective view of one embodiment of a spray nozzle unit of the present invention.

FIG. 8 is an enlarged, exploded perspective view of an alternative embodiment of a spray nozzle unit of the invention.

DETAILED DESCRIPTION OF PREFERRED EMBODIMENTS

The present invention involves an improved system for forming openings through a substrate. Specifically, the invention uses a plurality of specialized components which enable the formation of multiple openings through a selected substrate in a simultaneous manner. This results in an enhanced degree of production efficiency, accuracy, and economy.

Figure 1:
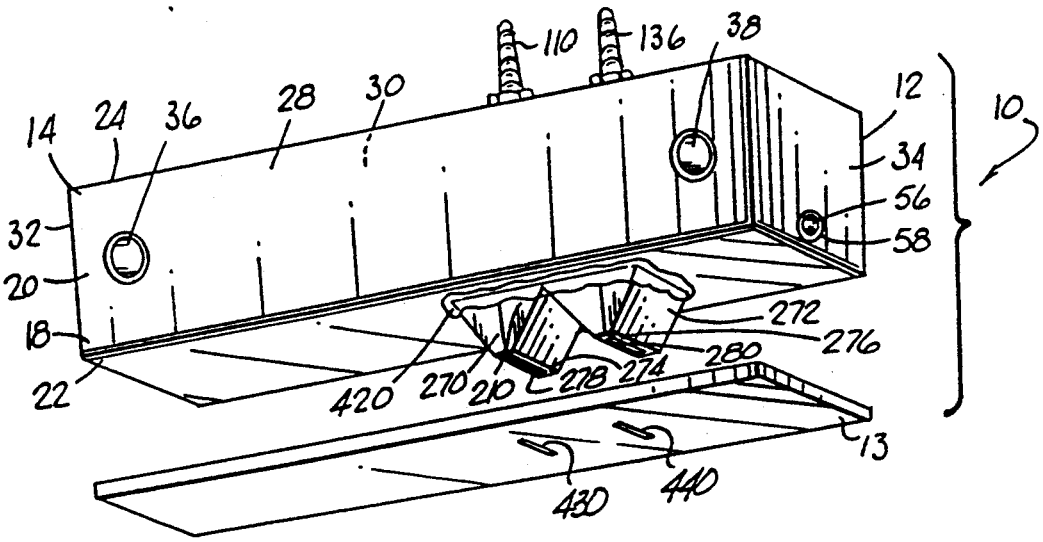
FIG. 1 is a perspective view of a retaining block having a spray nozzle unit therein produced in accordance with the present invention.

With reference to FIG. 1, a spraying head assembly 10 produced in accordance with the present invention is illustrated. The assembly 10 is designed to be used with a wide variety of abrasive jet machining (AJM) systems known in the art. An exemplary AJM system with which the assembly 10 may be used is manufactured by Comco, Inc. of Burbank, Calif. under the designation "MB102 MICROBLASTER." This system consists of a dual tank machine which includes an air inlet valve, a pressure regulating valve, a pressure gage, dual pressure modulators, and dual abrasive powder tanks, each tank being associated with a mixing chamber. The system and its components are described in U.K. Patent 1,243,294, and in U.S. Pat. Nos. 3,053,016; 3,084,484; and 3,638,839. In operation, a pressurized gas flow is directed through a pressure modulating valve which opens and closes at about 60 Hz. According to instructional literature provided with the system by Comco, Inc., the gas subsequently flows into a mixing chamber which is positioned beneath a container having a supply of abrasive powder therein. Both of these components are connected using a calibrated orifice. A slight difference in pressure exists with respect to the powder above the calibrated orifice and the mixing chamber. This pressure difference forces some of the powder to fall into the mixing chamber as the pressure drops. Within the mixing chamber, the powder is combined with air. The powder and air mixture thereafter passes outwardly from the system through one or more hose units. The hose units are connected to the assembly 10 as described below.

The foregoing system is designed to accommodate abrasive particles ranging in size from about 10–200 microns in diameter. Exemplary abrasive particles which may be used in accordance with this system and the assembly 10 are described below in Table 1:

TABLE 1

| Material | Particle Size (microns) (individual) | (range) | Recommended Uses |
|---|---|---|---|
| Aluminum Oxide | 10 | 5–30 | Cleaning, deburring, light cutting |
| Aluminum Oxide | 25 | 15–45 | Cleaning, deburring, light/med. cutting |
| Aluminum Oxide | 50 | 30–80 | Cleaning, deburring, medium/hvy. cutting |
| Glass Beads | 50 | 40–80 | Cleaning, deburring, polishing, peening |
| Silicon Carbide | 20 | 10–40 | Deburring, medium/hvy. cutting |
| Silicon Carbide | 50 | 30–80 | Deburring, very hvy. cutting |
| Sodium Bicarbonate | 150 | 5–200 | Cleaning, deburring, very light cutting |
| Walnut Shells | 250 | 80–300 | Cleaning, deburring, polishing |

Openings in many different substrates may be cut using the present invention, including metals, plastics, glass, and silicon. However, the invention shall not be limited to the cutting of any specific substrate material. Likewise, the invention shall not be limited to the use of any particular AJM system or abrasive powder. A wide variety of different systems and powders may be used.

Figure 2:
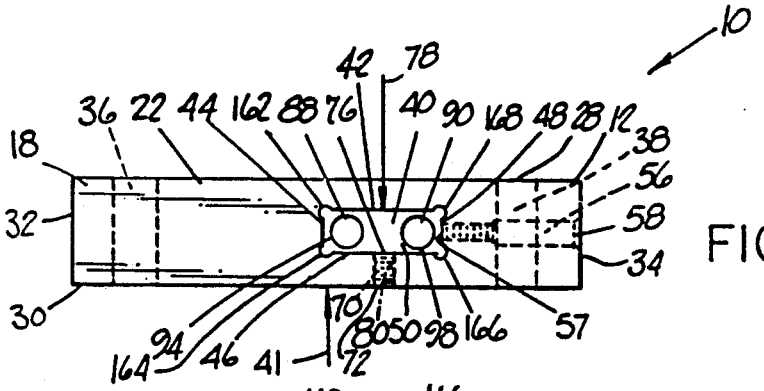
FIG. 2 is a bottom view of the retaining block of FIG. 1 prior to the mounting of a spray nozzle unit therein.
Figure 4:
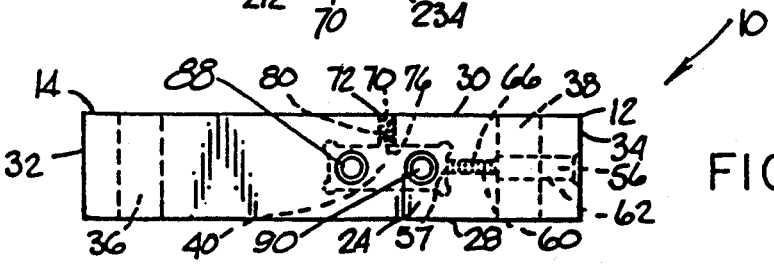
FIG. 4 is a top view of the retaining block of FIG. 1 prior to the mounting of a spray nozzle unit therein.

With continued reference to FIG. 1, a retaining member 12 in the form of a solid rectangular block is illustrated above a substrate 13. The member 12 includes an upper section 14, a lower section 18, and a medial section 20. Specifically, the lower section 18 includes a lower face 22 (FIGS. 1 and 2), and the upper section 14 includes an upper face 24 (FIGS. 1 and 4). In the present embodiment, the lower face 22 is substantially parallel to the upper face 24. Also provided are parallel side faces 28, 30 (FIGS. 1 and 2). Finally, parallel end faces 32, 34 are provided as illustrated in FIGS. 1 and 2. While the present embodiment characterizes the retaining member 12 as a rectangular block, alternative, non-rectangular forms may be used. Thus, the present invention shall not be limited to a retaining member 12 which is rectangular in configuration.

To construct the retaining member 12, a durable, light-weight metal is preferably used. Exemplary metals for this purpose include aluminum and steel. In an alternative embodiment, an inert, moldable plastic such as polyurethane may be used.

The retaining member 12 is adapted for attachment to a support stand (not shown) which may take a variety of forms known in the art. Attachment is accomplished by the placement of screws, bolts or other known fasteners through side bores 36, 38 which extend entirely through the medial section 20 of the retaining member 12 adjacent end faces 32, 34, respectively. In a preferred embodiment, the axes "A" of the bores 36, 38 are substantially perpendicular to the longitudinal center axis "B" of the retaining member 12 as shown in FIG. 6.

With reference to FIG. 2, the lower face 22 of the lower section 18 includes a rectangular cavity 40 therein which is slightly offset from the midpoint 41 of the retaining member 12. The cavity 40 is preferably rectangular in configuration, and has a depth "D" (FIG. 3) equal to about ¼ the vertical thickness "E" of the retaining member 12. The cavity 40 further includes interior side walls 42, 44, 46, 48, and a bottom wall 50.

Figure 3:
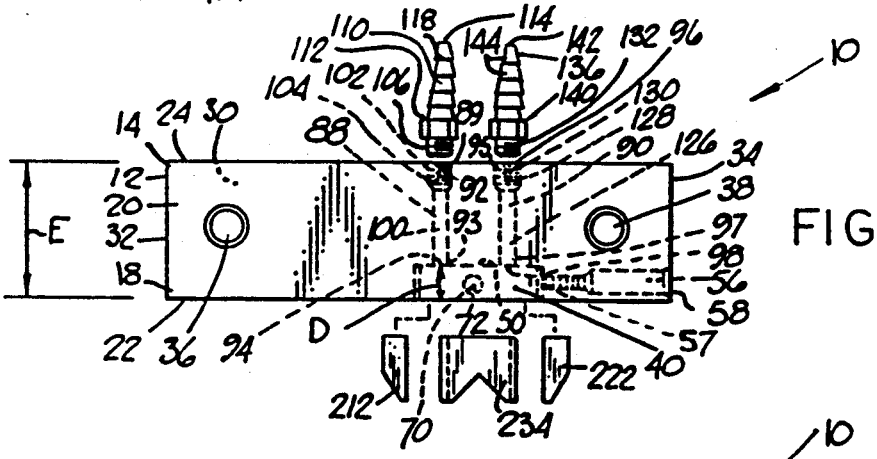
FIG. 3 is a side, partially exploded view of the retaining block and spray nozzle unit of FIG. 1.

Extending into the cavity 40 from end face 34 is first side port 56. The port 56 begins at an opening 58 in the end face 34, extends inwardly through the retaining member 12, and terminates at an opening 57 in the interior side wall 48 within the cavity 40 (FIGS. 2 and 3). The port 56 has an axis "F" which is substantially parallel to the longitudinal center axis "B" of the retaining member 12 (FIG. 6). In addition, the port 56 actually consists of two sections 60, 62, with the section 60 having a smaller diameter than that of section 62 (FIG. 4). Also, the section 60 has internal screw threads 66 which correspond to the thread pattern of a set screw (not shown) which is threadably engaged within the section 60. The function of the set screw will be described hereinafter.

The retaining member 12 further includes a second side port 70 (FIG. 4) which extends inwardly through the lower section 18 of the retaining member 12. Specifically, the port 70 begins at an opening 72 in the side face 30 of the retaining member 12 and terminates at an opening 76 in the interior side face 46 of the cavity 40 (FIG. 2). As shown in FIG. 2, the opening 76 is positioned approximately at the midpoint 78 of the cavity 40. The port 70 has an axis "G" which is perpendicular to and coplanar with the axis "F" of the port 56. Also, the port 70 has internal screw threads 80 (FIG. 4) which correspond to the thread pattern of a set screw (not shown) which is threadably engaged with the port 70. The function of the set screw will be described below.

With reference to FIGS. 2-3, the retaining member 12 further includes dual main ports 88, 90 which extend through the retaining member 12 as illustrated. Specifically, as shown in FIG. 3, port 88 has a first end 89 which begins at an opening 92 through the upper face 24 of the upper section 14, and extends downwardly through the medial section 20. The port 88 has a second end 93 which terminates at and is in fluid communication with an opening 94 in the bottom wall 50 of the cavity 40 as shown in FIG. 3. Likewise, the port 90 has a first end 95 which begins at an opening 96 through the upper face 24 of the upper section 14, and extends downwardly through the medial section 20 of the retaining member 12. The port 90 has a second end 97 which terminates at and is in fluid communication with an opening 98 in the bottom wall 50 of the cavity 40. The longitudinal axis "H" of the port 88 is parallel to the longitudinal axis "I" of the port 90. In addition, both axes "H" and "I" are substantially perpendicular to the longitudinal center axis "B" of the retaining member 12 (FIG. 6).

As illustrated in FIG. 3, each of the ports 88, 90 actually includes two main sections. Port 88 includes a first section 100, and a second section 102 which has a greater diameter than that of the first section 100. The second section 102 also includes an internally threaded region 104 which is designed to threadably engage the threaded end 106 of a hose connector 110. The hose connector 110 is of a type known in the art, and includes a hexagon-shaped section 112, and a connecting section 114 having a plurality of individual segments 118 which are designed to frictionally engage a hose (not shown) used to connect the assembly 10 to a source of abrasive particles in the AJM system (not shown).

Likewise, port 90 includes a first section 126, and a second section 128 which has a greater diameter than that of the first section 126. The second section 128 also includes an internally threaded region 130 which is designed to threadably engage the threaded end 132 of a hose connector 136. The hose connector 136 is comparable in structure to the hose connector 110. The hose connector 136 also includes a hexagon-shaped section 140, and a connecting section 142 having a plurality of individual segments 144 which are designed to frictionally engage a hose (not shown) in the same manner described above with reference to connector 110.

In addition, an adhesive cement known in the art (e.g. adhesives sold under the brand names "Loctite RC/609" and "Permodex 26") may be applied to the threaded ends 106, 132 of the hose connectors 110, 136 so that they may be firmly secured in position.

With reference to FIG. 2, an additional feature of the cavity 40 in the retaining member 12 is illustrated. Specifically, each of the four corners of the cavity 40 includes a downwardly extending channel 162, 164, 166, 168. The channels 162, 164, 166, 168 begin at the lower face 22 of the retaining member 12, and terminate at the bottom wall 50 of the cavity 40. The function of channels 162, 164, 166, 168 will be described hereinafter.

Figure 9:
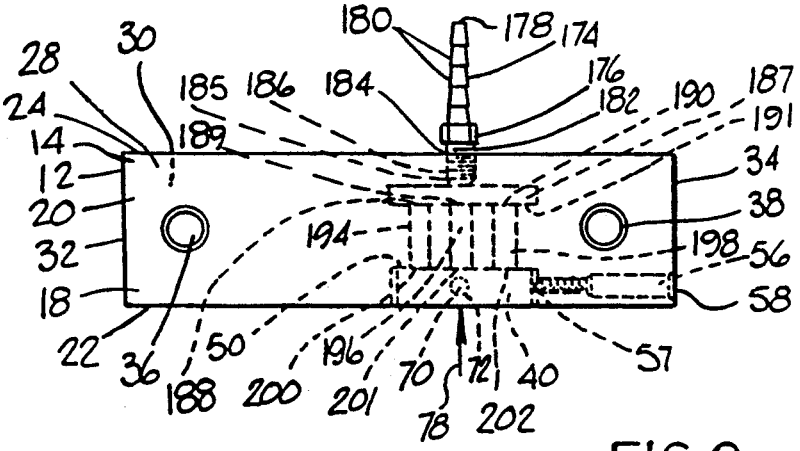
FIG. 9 is a side view of the retaining block in an alternative embodiment of the invention prior to the mounting of a spray nozzle unit therein.

An alternative, single port/hose connector embodiment of the retaining member 12 used in the assembly 10 is illustrated in FIG. 9. All of the components shown in FIG. 9 are substantially the same as those in FIGS. 1-4, except for the absence of the dual ports 88, 90, openings 92, 96, and dual connectors 110, 136. Instead, a single hose connector 174 is provided which includes a hexagon-shaped section 176, and a connecting section 178 having a plurality of individual segments 180. The connector 174 is in substantial alignment with the midpoint 78 of the cavity 40, and includes a threaded end 182 which is engaged within a single opening 184 in the upper face 24 of the upper section 14. The opening 184 extends into a single port 185 having an internally threaded region 186 which is designed to threadably engage the threaded end 182 of the connector 174. The port 185 extends into an expansion chamber 187 illustrated in FIG. 9. The expansion chamber 187 includes openings 188, 189, 190 in the bottom wall 191 thereof which lead into feed bores 194, 196, 198. The feed bores 194, 196, 198 terminate at openings 200, 201, 202 in the bottom wall 50 of the cavity 40. In this embodiment, particulate materials enter the connector 174, and pass into the expansion chamber 187 where they are distributed into feed bores 194, 196, 198. The feed bores 194, 196, 198 lead into the cavity 40 where the particulate materials thereafter enter a nozzle unit having internal passageways in alignment with the feed bores 194, 196, 198. A nozzle unit suitable for use with this embodiment is described below.

With reference to FIGS. 1 and 7, a spray nozzle unit 210 sized for receipt within the cavity 40 of the retaining member 12 is illustrated. The nozzle unit 210 consists of three components as shown in FIG. 7. A first end plate 212 is provided which includes a planar inner face 214 and an outer face 216. The outer face 216 consists of a lower section 218 and an inwardly angled upper section 220. A second end plate 222 is also provided which is identical to the first end plate 212. The second end plate 222 includes a planar inner face 224 and an outer face 226. The outer face 226 consists of a lower section 230 and an inwardly angled upper section 232.

Positioned between the first and second end plates 212, 222 is a medial member 234. The medial member 234 has a first end face 236 having a longitudinal channel 240 therein extending from the bottom 241 of the medial member 234 to the top 243 thereof as shown. The cross-sectional dimensions of the channel 240 are designed to approximate the size and shape of the bore to be produced in a substrate using the present invention. The first end face 236 is positioned against the inner face 214 of the first end plate 212 in the completed nozzle unit 210.

The medial member 234 also has a second end face 242 which is identical to the first end face 236. The second end face 242 has a longitudinal channel 246 therein extending from the bottom 241 of the medial member 234 to the top 243. Again, the cross-sectional dimensions of the channel 246 are designed to approximate the size and shape of the bore to be produced. The second end face 242 is positioned against the inner face 224 of the second end plate 222 in the completed nozzle unit 210.

Finally, the medial member 234 includes two diagonal faces 256, 258 between the first end face 236 and the second end face 242. The diagonal faces 256, 258 are positioned at an angle "Z" of about 60 to 90 degrees relative to each other, and form a V-shaped notch 260.

The completed nozzle unit 210 as shown in FIG. 7 includes two separate nozzle heads 270, 272 which are substantially triangular in shape. Each head 270, 272 further includes a flattened apex 274, 276. In the center of each apex 274, 276 is a passageway 278, 280. The passageways 278, 280 pass entirely through the nozzle unit 210, and consist of the channels 240, 246 positioned against the end plates 212, 222, respectively.

An alternative nozzle unit 300 is illustrated in FIG. 8. The nozzle unit 300 consists of five components. A first end plate 302 is provided which includes a planar inner face 304 and an outer face 306. The outer face 306 consists of a lower section 308 and an inwardly angled upper section 310. A second end plate 312 is also provided which is identical to the first end plate 302. The second end plate 312 includes a planar inner face 314 and an outer face 316. The outer face 316 consists of a lower section 318 and an inwardly angled upper section 320.

Also included is a first intermediate plate 322 which has an inner face 324 and an outer face 326. The outer face 326 has two longitudinal channels 328, 330 therein, and the inner face 324 has a single longitudinal channel 332 therein as illustrated. The channels 328, 330, 332 extend from the bottom 333 of the first intermediate plate 322 to the top 335 thereof. The cross-sectional dimensions of the channels 328, 330, 332 are designed to approximate the size and shape of the bores to be produced using the present invention. In addition, the outer face 326 is positioned against the inner face 304 of the first end plate 302 in the completed nozzle unit 300.

With continued reference to FIG. 8, the nozzle unit 300 includes a second intermediate plate 334 which has an inner face 336 and an outer face 338. The outer face 338 has a single longitudinal channel 340 therein, and the inner face 336 has two longitudinal channels 342, 344 as illustrated. The channels 340, 342, 344 extend from the bottom 345 of the second intermediate plate 334 to the top 346 thereof. Again, the cross-sectional dimensions of the channels 340, 342, 344 are designed to approximate the size and shape of the bores to be produced. In addition, the outer face 338 is positioned against the inner face 314 of the second end plate 312.

Positioned between the first and second intermediate plates 322, 334 is a medial member 350. The medial member 350 has a first planar end face 352 which is positioned against the inner face 324 of the first intermediate plate 322 in the completed nozzle unit 300.

The medial member 350 also has a second planar end face 354 which is identical to the first end face 352. The second end face 354 is positioned against the inner face 336 of the second intermediate plate 334 in the completed nozzle unit 300.

Finally, the medial member 350 includes two diagonal faces 360, 362 between the first end face 352 and the second end face 354. The diagonal faces 360, 362 are positioned at an angle "Z" of about 60 to 90 degrees relative to each other, and form a V-shaped notch 364.

The completed nozzle unit 300 as shown in FIG. 8 includes two separate nozzle heads 366, 368 which are substantially triangular in shape. Each head 366, 368 further includes a flattened apex 370, 372. Positioned within apex 370 are passageways 373, 374, 375 which pass entirely through the nozzle unit 300. The passageways 373, 374, 375 consist of the channels 328, 330, 332 bounded by the inner face 304 of the first end plate 302 and the first end face 352 of the medial member 350. Likewise, positioned within apex 372 are passageways 377, 378, 379 which pass entirely through the nozzle unit 300. The passageways 377, 378, 379 consist of the channels 340, 342, 344 bounded by the inner face 314 of the second end plate 312 and the second end face 354 of the medial member 350.

Figure 10:
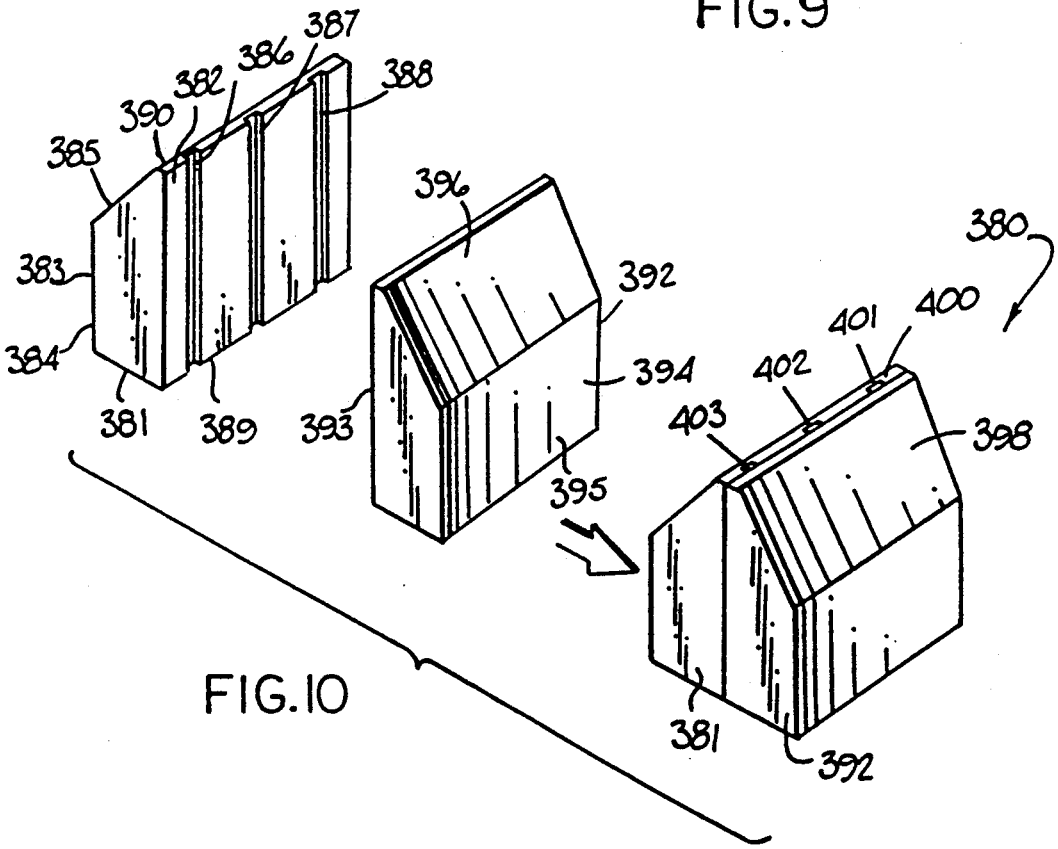
FIG. 10 is an enlarged, exploded perspective view of a further alternative embodiment of a spray nozzle unit adapted for use with the retaining block of FIG. 9.

A further alternative embodiment of a nozzle unit 380 suitable for use with the retaining member 12 of FIG. 9 is shown in FIG. 10. The nozzle unit 380 consists of two components. A first plate 381 is provided which includes a planar inner face 382 and an outer face 383. The outer face 383 consists of a lower section 384 and an inwardly angled upper section 385. The inner face 382 has three longitudinal channels 386, 387, 388 therein which extend from the bottom 389 of the plate 381 to the top 390 thereof. The cross-sectional dimensions of the channels 386, 387, 388 are designed to approximate the size and shape of the bores to be produced using the present invention.

Also included is a second plate 392 which includes a planar inner face 393 and an outer face 394. The outer face 394 consists of a lower section 395 and an inwardly angled upper section 396.

The completed nozzle unit 380 consists of a single head 398 which is substantially triangular in shape. The head 398 includes a flattened apex 400.

Positioned within apex 400 are passageways 401, 402, 403 which pass entirely through the nozzle unit 380. The passageways 401, 402, 403 consist of the channels 386, 387, 388 bounded by the inner face 393 of the second plate 392.

The nozzle units 210, 300, 380 of the present invention are preferably made of a durable, abrasion-resistant composition. Exemplary compositions for this purpose include ceramic, fiber-reinforced ceramic, tungsten carbide, silicon carbide, and sapphire.

The components described above which are used to construct the nozzle unit 210 (or 300, 380) are inserted within the cavity 40 of the retaining member 12 in order to form the assembly 10 illustrated in FIGS. 1 and 6. The cavity 40 is preferably sized so that the foregoing components will mate together in a tight, abutting relationship when positioned within the cavity 40. The set screws within ports 56, 70 may then be suitably tightened in order to engage the nozzle unit within the cavity 40. Thereafter, a portion of adhesive 420 known in the art is positioned around the nozzle unit in an amount sufficient to cover any gaps between the nozzle unit and the side walls of the cavity 40. Exemplary adhesive materials for this purpose include epoxy resins known in the art (e.g. those sold under the DURO or LOCTITE trademarks). The adhesive 420 maintains the nozzle unit within the cavity 40, and also provides an air-tight seal therebetween. Furthermore, the channels 162, 164, 166, 168 at the corners of the cavity 40 allow some of the adhesive 420 to flow downwardly therethrough. This process further enhances the structural integrity of the assembly 10.

In operation, the assembly 10 is positioned directly over a substrate 13 as shown in FIG. 1. In a preferred embodiment, the apices 274, 276 of the nozzle unit 210 are positioned at a distance of about 0.050–0.250 inches above the substrate 13. Abrasive particulate materials are introduced into the assembly 10 from a source in an AJM system known in the art (not shown) through the hose connectors 110, 136. Thereafter, with reference to the embodiment shown in FIG. 1, the particulate materials enter passageways 278, 280 within the nozzle heads 270, 272 from the ports 88, 90 which are directly aligned with the passageways 278, 280. As a result, two separately-flowing streams of particulate materials are created within the nozzle unit 210. The streams subsequently exit the passageways 278, 280 and strike the substrate 13, thereby creating openings 430, 440.

As described herein, the present invention enables multiple openings to be simultaneously created in a substrate through the use of at least two, independently-flowing streams of abrasive particulate materials. This process is highly efficient, accurate, and economical. Having herein described a preferred embodiment of the present invention, it is anticipated that suitable modifications may be made thereto by individuals skilled in the art which come within the scope of the invention as claimed. For example, the dimensional and configurational characteristics of the retaining member and spray nozzle unit may be varied within the scope of the invention. Likewise, the configuration and orientation of the passageways, ports, etc in the above-described assembly may be varied. Thus, the present invention shall only be construed in accordance with the following claims:

We claim:

1. An apparatus for directing a high-velocity flow or particulate materials from a supply of said particulate materials onto a substrate in order to form a plurality of openings through said substrate comprising:

a retaining member comprising a body portion having a upper section and a lower section, said upper section comprising an upper face having a plurality of individual openings therein and said lower section comprising a cavity therein, said retaining member further comprising a plurality of individual ports passing therethrough, each of said ports being straight and parallel to each other and having a first end beginning at one of said openings in said upper face of said upper section and extending through said upper section, each of said ports further comprising a second end terminating within said retaining member, said second end being in fluid communication with said cavity in said lower section; and a spray nozzle unit fixedly secured within said cavity, said spray nozzle unit comprising at least two passageways therethrough, said passageways being spaced apart from each other, and each of said passageways being in fluid communication with at least one of said ports.

2. The apparatus of claim 1 wherein said retaining member comprises a rigid, rectangular block comprised of a material selected from the group consisting of metal and plastic.

3. The apparatus of claim 1 wherein said cavity in said lower section of said retaining member is rectangular in configuration.

4. An apparatus for directing a high-velocity flow of particulate materials from a supply of said particulate materials onto a substrate in order to form a plurality of openings through said substrate comprising:

a retaining member comprising a rigid block, said block comprising an upper section and a lower section, said lower section comprising a cavity therein, said block further comprising at least one port passing therethrough having a first end positioned at and extending through said upper section and a second end terminating within said block, said second end being in fluid communication with said cavity in said lower section;

a spray nozzle unit fixedly secured within said cavity, said spray nozzle unit comprising at least two passageways therethrough, said passageways being spaced apart from each other, said spray nozzle unit comprising:

a first end plate;

a second end plate;

a first intermediate plate comprising an inner face and an outer face, said inner face and said outer face each comprising at least one longitudinal channel therein, said first end plate being positioned against said outer face of said first intermediate plate;

a second intermediate plate comprising an inner face and an outer face, said inner face and said outer face each comprising at least one longitudinal channel therein, said second end plate being positioned against said outer face of said second intermediate plate;

a medial member positioned between said first intermediate plate and said second intermediate plate, said medial member comprising a first end face and a second end face, said first end face of said medial member being positioned against said inner face of said first intermediate plate, and said second end face of said medial member being positioned against said inner face of said second intermediate plate, said longitudinal channel in each of said inner face and said outer face of said first intermediate plate and said second intermediate plate comprising one of said passageways through said spray nozzle unit; and a portion of adhesive material positioned on said lower section of said block and completely surrounding said spray nozzle unit, said portion of adhesive material covering any gaps between said spray nozzle unit and said cavity in order to provide an air-tight seal therebetween.

5. The apparatus of claim 1 wherein said spray nozzle unit comprises at least two downwardly extending spray heads, at least one of said passageways passing through each of said spray heads of said spray nozzle unit.

6. The apparatus of claim 5 wherein each of said spray heads is triangular in configuration and comprises a flattened apex, at least one of said passageways in said spray nozzle unit passing through said flattened apex of each of said spray heads.

7. An apparatus for directing a high-velocity flow of particulate materials from a supply of said particulate materials onto a substrate in order to form a plurality of openings through said substrate comprising:

a retaining member comprising a body portion having a upper section and a lower section, said lower section comprising a cavity therein, said retaining member further comprising at least one port passing therethrough having a first end positioned at and extending through said upper section, and a second end terminating within said retaining member, said second end being in fluid communication with said cavity in said lower section; and a spray nozzle unit fixedly secured within said cavity, said spray nozzle unit comprising at least two passageways therethrough, said passageways being spaced apart from each other, said spray nozzle unit comprising:

a first end plate;

a second end plate; and a medial member positioned between said first end plate and said second end plate, said medial member comprising a first end face and a second end face, said first end face and said second end face each comprising at least one longitudinal channel therein, said first end plate being positioned against said first end face of said medial member, and said second end plate being positioned against said second end face of said medial member, said longitudinal channel in each of said first end face and said second end face of said medial member comprising one of said passageways through said spray nozzle unit.

8. The apparatus of claim 7 wherein said medial member further comprises a V-shaped notch between said first end face and said second end face thereof.

9. An apparatus for directing a high-velocity flow of particulate materials from a supply of said particulate materials onto a substrate in order to form a plurality of openings through said substrate comprising:

a retaining member comprising a body portion having a upper section and a lower section, said lower section comprising a cavity therein, said retaining member further comprising at least one port passing therethrough having a first end positioned at and extending through said upper section, and a second end terminating within said retaining member, said second end being in fluid communication with said cavity in said lower section; and a spray nozzle unit fixedly secured within said cavity, said spray nozzle unit comprising at least two passageways therethrough, said passageways being spaced apart from each other, said spray nozzle unit comprising:

a first end plate;

a second end plate;

a first intermediate plate comprising an inner face and an outer face, said inner face and said outer face each comprising at least one longitudinal channel therein, said first end plate being positioned against said outer face of said first intermediate plate;

a second intermediate plate comprising an inner face and an outer face, said inner face and said outer face each comprising at least one longitudinal channel therein, said second end plate being positioned against said outer face of said second intermediate plate; and a medial member positioned between said first intermediate plate and said second intermediate plate, said medial member comprising a first end face and a second end face, said first end face of said medial member being positioned against said inner face of said first intermediate plate, and said second end face of said medial member being positioned against said inner face of said second intermediate plate, said longitudinal channel in each of said inner face and said outer face of said first intermediate plate and said second intermediate plate comprising one of said passageways through said spray nozzle unit.

10. The apparatus of claim 9 wherein said medial member further comprises a V-shaped notch between said first end face and said second end face thereof.

11. The apparatus of claim 1 wherein said spray nozzle unit is comprised of a material selected from the group consisting of ceramic, tungsten carbide, silicon carbide, and sapphire.

12. The apparatus of claim 1 further comprising a portion of adhesive material positioned on said lower section of said retaining member and completely surrounding said spray nozzle unit, said portion of adhesive material covering any gaps between said spray nozzle unit and said cavity in order to provide an air-tight seal therebetween.

13. An apparatus for directing a high-velocity flow of particulate materials from a supply of said particulate materials onto a substrate in order to form a plurality of openings through said substrate comprising;

a retaining member comprising a body portion having an upper section and a lower section, said lower section comprising a cavity therein, said retaining member further comprising at least one port passing therethrough having a first end positioned at and extending through said upper section, and a second end terminating within said retaining member, said second end being in fluid communication with said cavity in said lower section; and a spray nozzle unit fixedly secured within said cavity, said spray nozzle unit comprising at least two downwardly extending spray heads, each of said spray heads being triangular in configuration and comprising a flattened apex, each of said spray heads further comprising at least one passageway therethrough, said passageway terminating at said flattened apex.

14. An apparatus for directing a high-velocity flow of particulate materials from a supply of said particulate materials onto a substrate in order to form a plurality of openings through said substrate comprising:

a retaining member comprising an upper section and a lower section, said lower section comprising a cavity therein, said retaining member further comprising a port beginning at said upper section of said retaining member and passing therethrough, a chamber within said retaining member in fluid communication with said port, and a plurality of feed bores between and in fluid communication with said chamber and said cavity; and a spray nozzle unit fixedly secured within said cavity, said spray nozzle unit comprising a plurality of passageways therethrough, said passageways being in fluid communication and alignment with said feed bores in said retaining member, the number of said feed bores being equal to the number of said passageways in said spray nozzle unit, said spray nozzle unit comprising:

a first plate comprising an outer face and an inner face, said inner face comprising a plurality of longitudinal channels therein; and a second plate comprising an outer face and an inner face, said inner face of said second plate being positioned against said inner face of said first plate, each of said longitudinal channels in said inner face of said first plate comprising one of said passageways through said spray nozzle unit.

15. The apparatus of claim 13 further comprising a portion of adhesive material positioned on said lower section of said retaining member and completely surrounding said spray nozzle unit, said portion of adhesive material covering any gaps between said spray nozzle unit and said cavity in order to provide an air-tight seal therebetween.

16. An apparatus for directing a high-velocity flow of particulate materials from a supply of said particulate materials onto a substrate in order to form a plurality of openings through said substrate comprising:

a retaining member comprising a rigid block, said block comprising an upper section and a lower section, said lower section comprising a cavity therein, said block further comprising at least one port passing therethrough having a first end positioned at and extending through said upper section and a second end terminating within said block, said second end being in fluid communication with said cavity in said lower section;

a spray nozzle unit fixedly secured within said cavity, said spray nozzle unit comprising at least two passageways therethrough, said passageways being spaced apart from each other, said spray nozzle unit comprising:

a first end plate;

a second end plate; and a medial member positioned between said first end plate and said second end plate, said medial member comprising a first end face and a second end face, said first end face and said second end face each comprising at least one longitudinal channel therein, said first end plate being positioned against said first end face of said medial member, and said second end plate being positioned against said second end face of said medial member, said longitudinal channel in each of said first end face and said second end face of said medial member comprising one of said passageways through said spray nozzle unit; and a portion of adhesive material positioned on said lower section of said block and completely surrounding said spray nozzle unit, said portion of adhesive material covering any gaps between said spray nozzle unit and said cavity in order to provide an air-tight seal therebetween.

* * * * *